US009658570B2

(12) United States Patent
Nagashima et al.

(10) Patent No.: US 9,658,570 B2
(45) Date of Patent: May 23, 2017

(54) DEVELOPING DEVICE INCLUDING A TONER RECEIVING MEMBER VIBRATED BY A VIBRATION GENERATION DEVICE, AND IMAGE FORMING APPARATUS INCLUDING THE SAME

(71) Applicant: KYOCERA Document Solutions Inc., Osaka (JP)

(72) Inventors: Teruhiko Nagashima, Osaka (JP); Mitsuhiro Goda, Osaka (JP); Hidenori Takenaka, Osaka (JP); Takahisa Nakaue, Osaka (JP); Yoshimi Shimizu, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/211,948

(22) Filed: Jul. 15, 2016

(65) Prior Publication Data

US 2017/0023881 A1 Jan. 26, 2017

(30) Foreign Application Priority Data

Jul. 24, 2015 (JP) ..... 2015-146877

(51) Int. Cl.
*G03G 15/08* (2006.01)

(52) U.S. Cl.
CPC ..... *G03G 15/0887* (2013.01); *G03G 15/0812* (2013.01)

(58) Field of Classification Search
CPC ..... G03G 15/0887
See application file for complete search history.

(56) References Cited

U.S. PATENT DOCUMENTS

2012/0201575 A1 8/2012 Kashimoto et al.

FOREIGN PATENT DOCUMENTS

JP 2012-208469 A 10/2012
JP 2014-6411 A 1/2014
JP 2014006411 A * 1/2014

OTHER PUBLICATIONS

JP_2014006411_A_T Jan. 2014, Japan, Nishimura et al.*

* cited by examiner

*Primary Examiner* — Clayton E Laballe
*Assistant Examiner* — Victor Verbitsky
(74) *Attorney, Agent, or Firm* — Stein IP, LLC

(57) ABSTRACT

A developing device of the present disclosure includes a developing roller, a toner supply roller, a regulation blade, a casing, a toner receiving support member, a toner receiving member, a vibration generation unit, and a vibration inhibition member. The toner receiving support member is disposed in the casing so as to be opposed to the developing roller or the toner supply roller in an area between the regulation blade and an image carrier. The toner receiving member has a toner receiving surface that receives toner dropping from the developing roller, and is supported so as to be swingable about an end edge thereof on a toner supply roller side as a fulcrum. In a state where the toner receiving member is not vibrating, the vibration inhibition member is in contact with each of both end portions of the toner receiving surface in a longitudinal direction thereof.

11 Claims, 13 Drawing Sheets

DEVELOPING DEVICE INCLUDING A TONER RECEIVING MEMBER VIBRATED BY A VIBRATION GENERATION DEVICE, AND IMAGE FORMING APPARATUS INCLUDING THE SAME

INCORPORATION BY REFERENCE

This application is based upon and claims the benefit of priority from the corresponding Japanese Patent Application No. 2015-146877 filed on Jul. 24, 2015, the entire contents of which are incorporated herein by reference.

BACKGROUND

The present disclosure relates to a developing device that supplies an image carrier with a developer and an electrophotographic image forming apparatus including the same.

In an electrophotographic image forming apparatus, a peripheral surface of an image carrier (photosensitive drum) is irradiated with light based on image information read from an original image or image information obtained by, for example, transmission from an external apparatus such as a computer so that an electrostatic latent image is formed, which then is supplied with toner from a developing device so that a toner image is formed, after which said toner image is transferred onto a paper sheet. The paper sheet that has thus gone through transfer processing is subjected to processing for fixing the toner image and then is ejected to an exterior.

By the way, with advances toward color printing and high-speed processing, an image forming apparatus of recent years has a more complicated configuration, and in a developing device thereof, high-speed rotation of a toner stirring member is necessitated in order to achieve such high-speed processing. Particularly in a development method that employs a two-component developer containing a magnetic carrier and toner and uses a magnetic roller (toner supply roller) that carries the developer and a developing roller that carries only the toner, at an opposing portion where the developing roller and the magnetic roller are opposed to each other, by a magnetic brush formed on the magnetic roller, only the toner is carried on the developing roller, and a part of the toner remaining without being used for development is peeled off from the developing roller. This makes it likely that suspension of toner occurs in a neighborhood of the opposing portion where the developing roller and the magnetic roller are opposed to each other, and the suspending toner is deposited at a periphery of an ear cutting blade (regulation blade). When the toner thus deposited flocculates and adheres to the developing roller, there is a possibility that toner dropping occurs to cause an image failure.

As a solution to this, for example, there is known a developing device that employs a two-component developer containing a magnetic carrier and toner and uses a magnetic roller that carries the developer and a developing roller that carries only the toner, in which there are provided a toner receiving support member that is opposed to the developing roller or the magnetic roller, a toner receiving member that is disposed along a longitudinal direction of the toner receiving support member and receives toner dropping from the developing roller, and a vibration generation unit that causes the toner receiving member to vibrate.

There is also known a developing device in which at each of both end portions of a toner receiving support member in a longitudinal direction thereof, a sheet-shaped vibration adjustment member is disposed at a prescribed spacing from a toner receiving member. In the developing device of this type, the toner receiving member, when it vibrates, comes in contact with the vibration adjustment member, so that a free end of the toner receiving member vibrates in an undulating manner while being bent in an arc to cause toner deposited on a free end side of the toner receiving member to move to a fulcrum side thereof.

SUMMARY

A developing device according to one aspect of the present disclosure includes a developing roller, a toner supply roller, a regulation blade, a casing, a toner receiving support member, a toner receiving member, a vibration generation unit, and a vibration inhibition member. The developing roller is disposed so as to be opposed to an image carrier on which an electrostatic latent image is formed and supplies toner to the image carrier in an opposing region where the developing roller is opposed to the image carrier. The toner supply roller is disposed so as to be opposed to the developing roller and supplies toner to the developing roller in an opposing region where the toner supply roller is opposed to the developing roller. The regulation blade is disposed so as to be opposed to the toner supply roller at a prescribed spacing therefrom. The casing houses the developing roller, the toner supply roller, and the regulation blade. The toner receiving support member is disposed in the casing so as to be opposed to the developing roller or the toner supply roller in an area between the regulation blade and the image carrier. The toner receiving member is disposed along a longitudinal direction of the toner receiving support member, has a toner receiving surface that receives toner dropping from the developing roller, and is supported so as to be swingable about an end edge thereof on a toner supply roller side as a fulcrum, with an end edge thereof on an image carrier side being a free end. The vibration generation unit causes the toner receiving member to vibrate. In a state where the toner receiving member is not vibrating, the vibration inhibition member is in contact with each of both end portions of the toner receiving surface in a longitudinal direction thereof.

Still other objects of the present disclosure and specific advantages provided by the present disclosure will be made further apparent from the following description of an embodiment.

DETAILED DESCRIPTION

Figure 1:
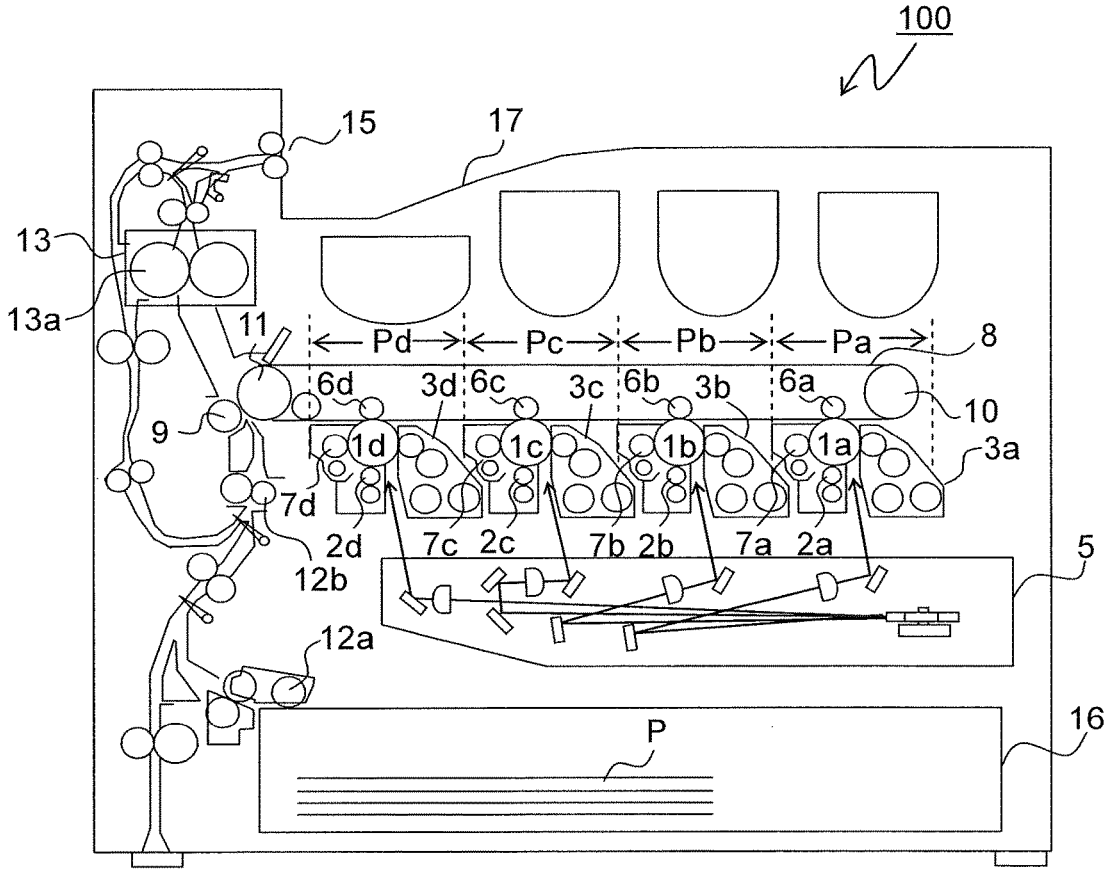
FIG. 1 is a schematic configuration diagram of a color printer 100 including developing devices 3*a* to 3*d* of the present disclosure.

With reference to the appended drawings, the following describes an embodiment of the present disclosure. FIG. 1 is a schematic sectional view of an image forming apparatus equipped with developing devices 3*a* to 3*d* of the present disclosure, showing a tandem color printer herein. In a main body of a color printer 100, four image forming portions Pa, Pb, Pc, and Pd are arranged in order from an upstream side in a conveyance direction (right side in FIG. 1). The image forming portions Pa to Pd are provided so as to correspond to images of four different colors (cyan, magenta, yellow, and black), respectively, and sequentially form images of cyan, magenta, yellow, and black, respectively, through processes of charging, exposure, development, and transfer.

In the image forming portions Pa to Pd, photosensitive drums 1*a*, 1*b*, 1*c*, and 1*d* to carry thereon visualized images (toner images) of the respective colors are arranged, respectively, and an intermediate transfer belt 8 that is driven to rotate by a drive unit (not shown) in a clockwise direction in FIG. 1 is provided adjacently to the image forming portions Pa to Pd.

A transfer sheet P onto which a toner image is to be secondarily transferred is housed in a paper sheet cassette 16 that is disposed at a lower portion in the main body of the color printer 100, and is conveyed, via a paper feed roller 12*a* and a registration roller pair 12*b*, to a nip portion between a secondary transfer roller 9 and a drive roller 11 of the intermediate transfer belt 8, which will be discussed later.

Next, a description is given of the image forming portions Pa to Pd. Around and below the photosensitive drums 1*a* to 1*d* that are rotatably arranged, there are provided chargers 2*a*, 2*b*, 2*c*, and 2*d* that charge the photosensitive drums 1*a* to 1*d*, respectively, an exposure device 5 that performs exposure based on image information with respect to the photosensitive drums 1*a* to 1*d*, developing devices 3*a*, 3*b*, 3*c*, and 3*d* that form toner images on the photosensitive drums 1*a* to 1*d*, respectively, and cleaning portions 7*a*, 7*b*, 7*c*, and 7*d* that remove a residual developer (toner) or the like remaining on the photosensitive drums 1*a* to 1*d*, respectively.

When image data is inputted from a host apparatus such as a personal computer, first, surfaces of the photosensitive drums 1*a* to 1*d* are uniformly charged by the chargers 2*a* to 2*d*, respectively. Subsequently, by the exposure device 5, irradiation with light is performed based on the image data so that electrostatic latent images based on the image data are formed on the photosensitive drums 1*a* to 1*d*, respectively. The developing devices 3*a* to 3*d* are filled with prescribed amounts of two-component developers containing toner of the respective colors of cyan, magenta, yellow, and black.

Then, by primary transfer rollers 6*a* to 6*d*, at a prescribed transfer voltage, an electric field is applied between each of the primary transfer rollers 6*a* to 6*d* and a corresponding one of the photosensitive drums 1*a* to 1*d*. This causes toner images of cyan, magenta, yellow, and black on the photosensitive drums 1*a* to 1*d* to be primarily transferred onto the intermediate transfer belt 8. After that, residual toner or the like remaining on the surfaces of the photosensitive drums 1*a* to 1*d* after the primary transfer is removed by the cleaning portion 7*a* to 7*d*, respectively.

The intermediate transfer belt 8 is laid to extend around and between a driven roller 10 on the upstream side and the drive roller 11 on a downstream side. As the drive roller 11 is driven to rotate by a drive motor (not shown), the intermediate transfer belt 8 starts to rotate in a clockwise direction. Then, at prescribed timing, the transfer sheet P is conveyed from the registration roller pair 12*b* to the nip portion (secondary transfer nip portion) between the drive roller 11 and the secondary transfer roller 9 that is provided adjacently to the drive roller 11, where a full-color image on the intermediate transfer belt 8 is secondarily transferred onto the transfer sheet P. The transfer sheet P onto which the toner image has thus been secondarily transferred is conveyed to a fixing portion 13.

The transfer sheet P thus conveyed to the fixing portion 13 is heated and pressed by a fixing roller pair 13*a* so that the toner image is fixed to a surface of the transfer sheet P, and thus a prescribed full-color image is formed. The transfer sheet P on which the full-color image has thus been formed is ejected onto an ejection tray 17 by an ejection roller pair 15.

Figure 2:
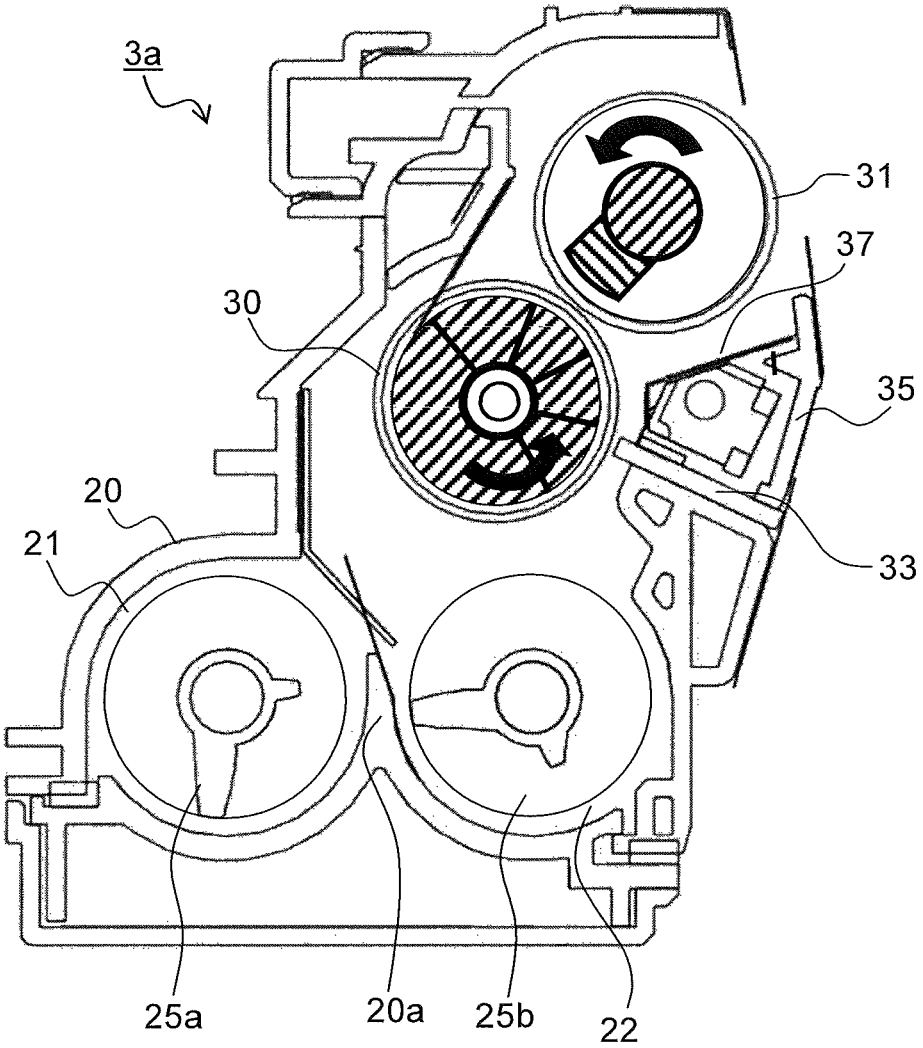
FIG. 2 is a side sectional view of a developing device 3*a* according to one embodiment of the present disclosure.

FIG. 2 is a side sectional view of a developing device 3*a* according to a first embodiment of the present disclosure. In FIG. 2, there is shown a state as seen from a rear side of FIG. 1, and various members in the developing device 3*a*, therefore, are shown to be disposed in laterally reversed positions. Furthermore, in the following description, the developing device 3*a* disposed in the image forming portion Pa shown in FIG. 1 is used as an example, and as for the developing devices 3*b* to 3*d* disposed in the image forming portions Pb to Pd, respectively, descriptions thereof are omitted since they basically have a similar configuration to that of the developing device 3*a*.

As shown in FIG. 2, the developing device 3*a* includes a development container (casing) 20 in which a two-component developer (hereinafter, referred to simply as a developer) is housed, and the development container 20 is divided by a partition wall 20*a* into a stir conveyance chamber 21 and a supply conveyance chamber 22. In the stir conveyance chamber 21 and the supply conveyance chamber 22, a stir conveyance screw 25*a* and a supply conveyance screw 25*b* for mixing toner (positively charged toner) supplied from a toner container 4*a* (see FIG. 1) with a carrier and stirring the mixture so that the toner is charged are rotatably arranged, respectively.

Further, by the stir conveyance screw 25*a* and the supply conveyance screw 25*b*, the developer is conveyed, while being stirred, in an axial direction (direction perpendicular to a paper plane of FIG. 2) and circulates between the stir conveyance chamber 21 and the supply conveyance chamber 22 via an unshown developer passage that is formed at each of both end portions of the partition wall 20*a*. That is, by the stir conveyance chamber 21, the supply conveyance chamber 22, and the developer passage, a circulation passage of the developer is formed in the development container 20.

The development container 20 extends obliquely right upward in FIG. 2. In the development container 20, a toner supply roller 30 (developer carrier) is disposed above the supply conveyance screw 25*b*, and with respect to the toner supply roller 30, a developing roller 31 is disposed obliquely right upward so as to be opposed thereto. Further, on an opening side (right side in FIG. 2) of the development container 20, the developing roller 31 is opposed to the photosensitive drum 1*a* (see FIG. 1), and the toner supply roller 30 and the developing roller 31 rotate around their respective rotation axes in a counterclockwise direction in FIG. 2.

In the stir conveyance chamber 21, an unshown toner concentration sensor is disposed so as to face the stir conveyance screw 25*a*, and based on a result of detection by the toner concentration sensor, the stir conveyance chamber 21 is replenished with toner from an unshown toner container via an unshown toner replenishment port. As the toner concentration sensor, for example, a magnetic permeability sensor is used that detects a magnetic permeability of a two-component developer composed of toner and a magnetic carrier in the development container 20.

The toner supply roller 30 is composed of a non-magnetic rotary sleeve that rotates in the counterclockwise direction in FIG. 2 and a stationary magnet body that has a plurality of magnetic poles and is internally housed in the rotary sleeve.

The developing roller 31 is composed of a cylindrical development sleeve that rotates in the counterclockwise direction in FIG. 2 and a developing roller-side magnetic pole that is fastened in the development sleeve. The toner supply roller 30 and the developing roller 31 are opposed to each other with a prescribed gap provided therebetween at their facing position (opposing position). The developing roller-side magnetic pole has a magnetic polarity opposite to that of one of the magnetic poles (main pole) of the stationary magnet body, which is opposed thereto.

Furthermore, in the development container 20, an ear cutting blade 33 is mounted along a longitudinal direction of the toner supply roller 30 (direction perpendicular to the paper plane of FIG. 2) and is positioned, in a rotation direction of the toner supply roller 30 (counterclockwise direction in FIG. 2), on an upstream side of an opposing position where the developing roller 31 and the toner supply roller 30 are opposed to each other. Further, a slight clearance (gap) is formed between a tip end portion of the ear cutting blade 33 and a surface of the toner supply roller 30.

A direct current voltage (hereinafter, denoted as Vslv (DC)) and an alternating current voltage (hereinafter, denoted as Vslv (AC)) are applied to the developing roller 31. A direct current voltage (hereinafter, denoted as Vmag (DC)) and an alternating current voltage (hereinafter, denoted as Vmag (AC)) are applied to the toner supply roller 30. These direct current voltages and alternating current voltages are applied to the developing roller 31 and the toner supply roller 30, respectively, from a development bias power source via a bias control circuit (neither of which is shown).

As discussed earlier, by the stir conveyance screw 25*a* and the supply conveyance screw 25*b*, a developer is caused to circulate, while being stirred, in the stir conveyance chamber 21 and the supply conveyance chamber 22 in the development container 20 so that toner is charged, and by the supply conveyance screw 25*b*, the developer is conveyed to the toner supply roller 30. Then, the developer forms a magnetic brush (not shown) on the toner supply roller 30. The magnetic brush on the toner supply roller 30 is regulated in layer thickness by the ear cutting blade 33 and then is conveyed to an opposing portion where the toner supply roller 30 and the developing roller 31 are opposed to each other. Based on a potential difference ΔV between Vmag (DC) applied to the toner supply roller 30 and Vslv (DC) applied to the developing roller 31 and a magnetic field, the magnetic brush forms a toner thin layer on the developing roller 31.

A thickness of the toner layer on the developing roller 31 can be controlled based on ΔV, though it also varies depending on a resistance of a developer, a difference in rotational speed between the toner supply roller 30 and the developing roller 31, or the like. The more a value of ΔV is increased, the thicker the toner layer on the developing roller 31 becomes, and the more the value of ΔV is decreased, the thinner the toner layer on the developing roller 31 becomes. In general, it is appropriate that ΔV at a time of development be in a range on the order of 100 V to 350 V.

The toner thin layer formed on the developing roller 31 as a result of contact with the magnetic brush on the toner supply roller 30 is conveyed by rotation of the developing roller 31 to an opposing portion (opposing region) where the photosensitive drum 1*a* and the developing roller 31 are opposed to each other. Since Vslv (DC) and Vslv (AC) have been applied to the developing roller 31, based on a potential difference between the developing roller 31 and the photosensitive drum 1*a*, the toner is caused to fly to develop an electrostatic latent image on the photosensitive drum 1*a*.

A part of the toner remaining without being used for the development is conveyed again to the opposing portion where the developing roller 31 and the toner supply roller 30 are opposed to each other and is collected by the magnetic brush on the toner supply roller 30. Further, the magnetic brush is peeled off from the toner supply roller 30 at a same polarity portion of the stationary magnet body and then drops into the supply conveyance chamber 22.

After that, based on a result of detection by the toner concentration sensor (not shown), a prescribed amount of toner is replenished through the toner replenishment port (not shown), and while the toner circulates in the supply conveyance chamber 22 and the stir conveyance chamber 21, there is again formed a uniformly charged two-component developer having a proper toner concentration. By the supply conveyance screw 25*b*, this developer is supplied again onto the toner supply roller 30 to form a magnetic brush thereon and then is conveyed to the ear cutting blade 33.

On a right side wall in the development container 20 shown in FIG. 2, in a neighborhood of the developing roller 31, a toner receiving support member 35 is provided that is triangular in cross section and protrudes to an inside of the development container 20. As shown in FIG. 2, the toner receiving support member 35 is disposed along a longitudinal direction of the development container 20 (direction perpendicular to the paper plane of FIG. 2), and an upper surface of the toner receiving support member 35 constitutes a wall portion that is opposed to the toner supply roller 30 and the developing roller 31 and is inclined downward in a direction from the developing roller 31 toward the toner supply roller 30. A toner receiving member 37 that receives toner peeled off from the developing roller 31 to drop thereon is mounted to the upper surface of the toner receiving support member 35 along a longitudinal direction thereof.

Figure 3:
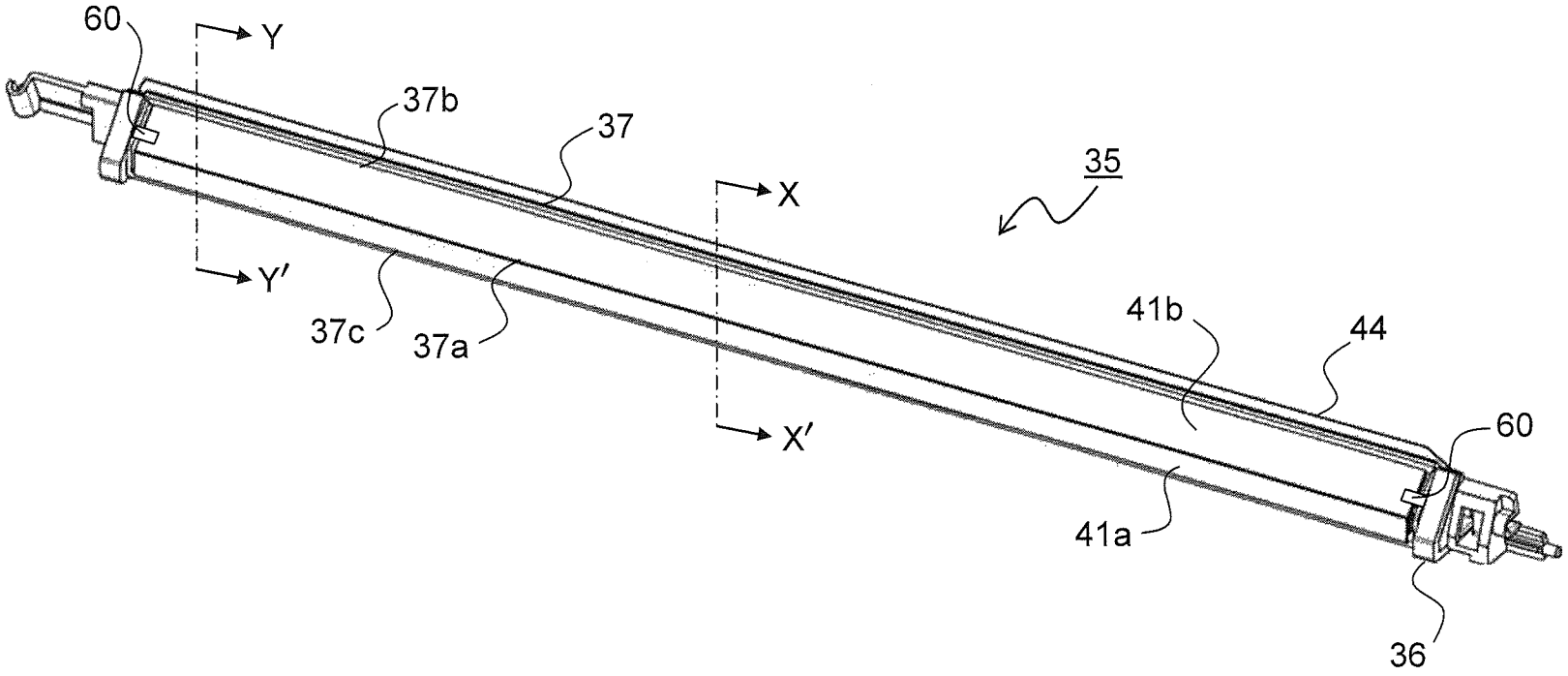
FIG. 3 is a perspective view of a toner receiving support member 35 used in the developing device 3*a* of this embodiment as seen from an inside of a development container 20.
Figure 4:
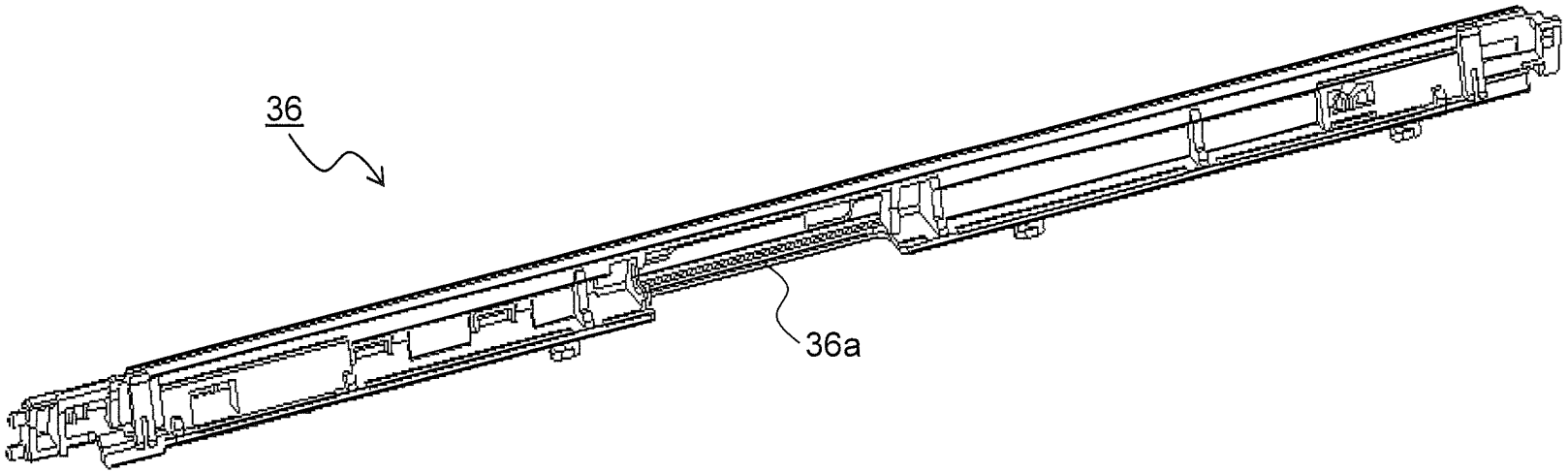
FIG. 4 is a perspective view of a support member main body 36 as a component of the toner receiving support member 35.
Figure 5:
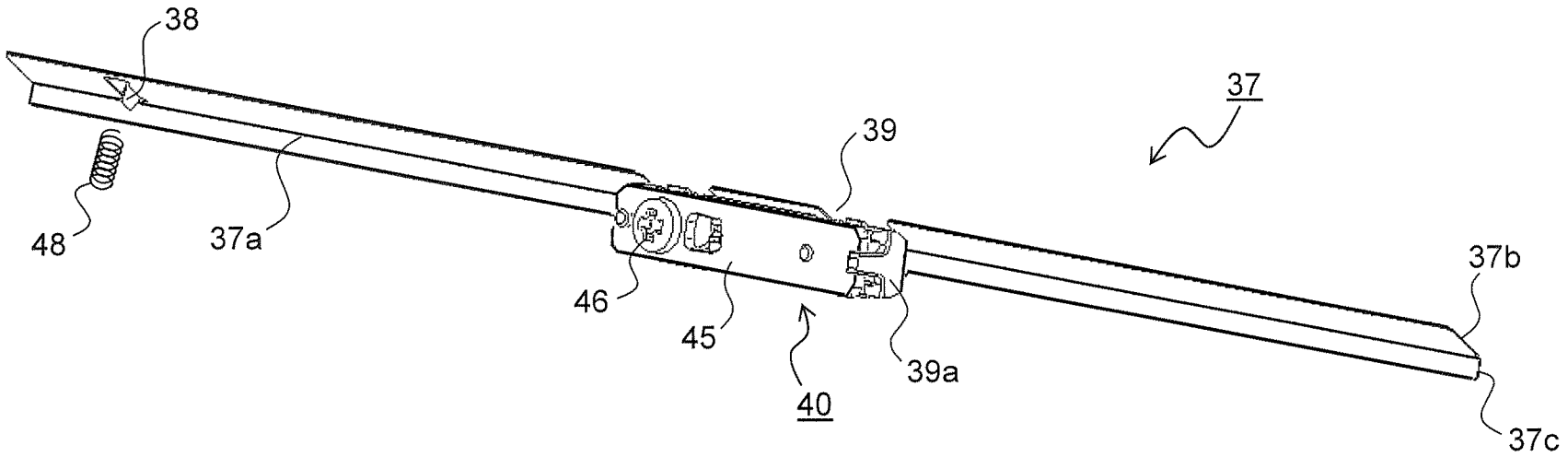
FIG. 5 is a perspective view of a toner receiving member 37 as a component of the toner receiving support member 35 as seen from a back side thereof.

FIG. 3 is a perspective view of the toner receiving support member 35 as seen from an inside of the development container 20 (left side in FIG. 2), FIG. 4 is a perspective view of a support member main body 36 as a component of the toner receiving support member 35, and FIG. 5 is a perspective view of the toner receiving member 37 as a component of the toner receiving support member 35 as seen from an inside of the toner receiving support member 35. FIG. 4 shows a state of the support member main body 36 as seen from a direction in which the toner receiving member 37 is mounted.

The toner receiving support member 35 has the resinous support member main body 36, the toner receiving member 37 that is made of sheet metal and is swingably supported to the support member main body 36, and a vibration generation device 40 that is attached to a substantially center portion of the toner receiving member 37 in a longitudinal direction thereof. In the support member main body 36, a housing portion 36*a* is formed to house the vibration generation device 40 when the toner receiving member 37 is mounted thereto.

Furthermore, at an upper end of the support member main body 36, a film-shaped seal member 44 is provided. The seal member 44 extends in a longitudinal direction of the support member main body 36 (lateral direction in FIG. 3) in such a manner that a tip end portion thereof is in contact with the surface of the photosensitive drum 1*a*, and has a function of blocking leakage of toner in the development container 20 (see FIG. 2) to an exterior.

Moreover, at each of both end portions of the support member main body 36 in the longitudinal direction thereof, a sheet-shaped vibration inhibition member 60 is fastened so as to be in contact with a surface of the toner receiving member 37. A material of the vibration inhibition member 60 is only required to have a certain level of stiffness, and as such a material, a PET film is used herein. A detailed configuration of the vibration inhibition member 60 will be discussed later.

The toner receiving member 37 has a bent shape in which a bent portion 37*a* is formed along the longitudinal direction thereof, and is divided into a toner receiving surface 37*b* that is opposed to the developing roller 31 (see FIG. 2) and a substantially perpendicular toner dropping surface 37*c* that is opposed to the toner supply roller 30, with the bent portion 37*a* interposed therebetween. Substantially on one end side of the toner receiving member 37 in the longitudinal direction thereof, an engagement portion 38 is formed in which a contact point spring 48 that grounds the toner receiving member 37 is to be engaged. A lower end portion of the contact point spring 48 comes in contact with the ear cutting blade 33 (see FIG. 2) via an electrically conducting spring receiving member (not shown). At the substantially center portion of the toner receiving member 37 in the longitudinal direction thereof, a holding portion 39 is formed that has a pair of holding lugs 39*a* to hold the vibration generation device 40. A substrate 45 on which a circuit and electronic components (not shown) for controlling driving of a vibration motor 43 (see FIG. 6) are mounted is fastened to the vibration generation device 40 by using a screw 46.

Sheet members 41*a* and 41*b* are glued to surfaces (opposing surfaces each opposed to the developing roller 31 or the toner supply roller 30) of the toner receiving member 37, respectively. In order to suppress toner adhesion to the toner receiving member 37, the sheet members 41*a* and 41*b* are made of a material to which toner is less likely to adhere than to the toner receiving member 37. Examples of the material of the sheet members 41*a* and 41*b* include, for example, a fluorine resin sheet.

Figure 6:
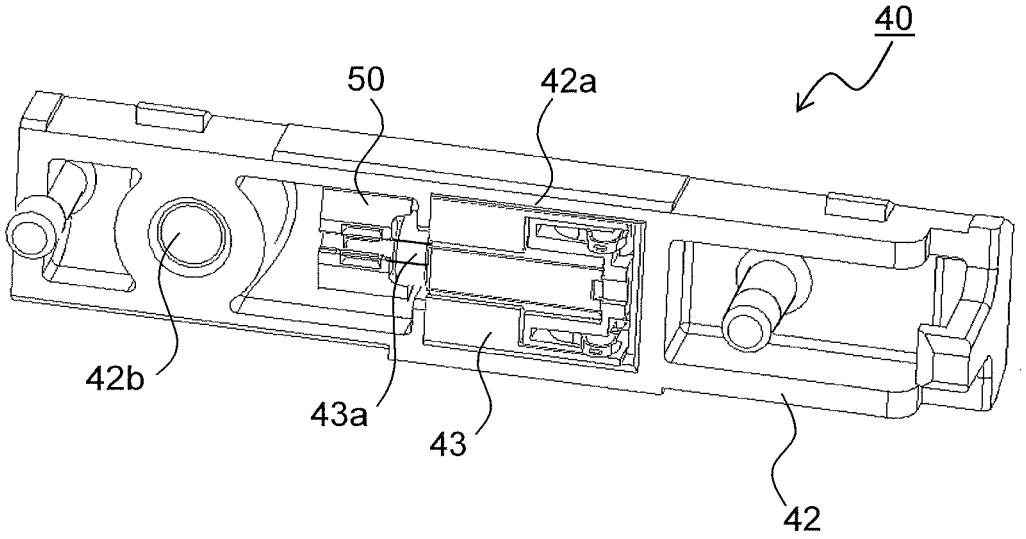
FIG. 6 is a perspective view showing an internal structure of a vibration generation device 40 mounted to the toner receiving member 37.

FIG. 6 is a perspective view of the vibration generation device 40. FIG. 6 shows a state in which the substrate 45 (see FIG. 5) has been demounted from a motor mounting holder 42 so that an interior of the vibration generation device 40 can be seen. The vibration generation device 40 includes the motor mounting holder 42 and the vibration motor 43, and in the motor mounting holder 42, there are formed a motor holding portion 42*a* to hold the vibration motor 43 and a screw hole 42*b* into which the screw 46 is to be screwed. A vibration-exciting weight 50 is fastened to an output shaft 43*a* of the vibration motor 43. The vibration motor 43 is fastened to the motor mounting holder 42 in such a manner that when the vibration generation device 40 is mounted to the toner receiving member 37, the output shaft 43*a* of the vibration motor 43 lies along the longitudinal direction of the toner receiving member 37. Furthermore, a lead wire (not shown) for supplying power to the vibration motor 43 is connected to the motor mounting holder 42.

Figure 7:
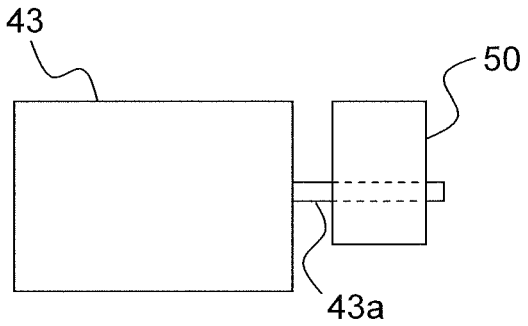
FIG. 7 is a front view of a vibration motor 43.
Figure 8:
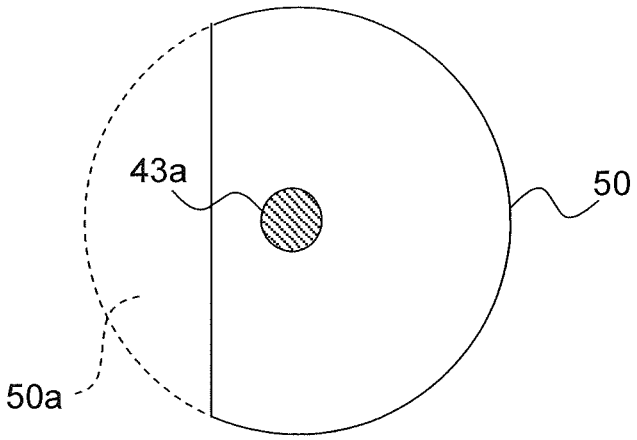
FIG. 8 is a side view of the vibration motor 43 as seen from a vibration-exciting weight 50 side.

FIG. 7 is a front view of the vibration motor 43, and FIG. 8 is a side view of the vibration motor 43 as seen from a vibration-exciting weight 50 side. When seen from a direction of the output shaft 43*a* of the vibration motor 43 (right direction in FIG. 7), as shown in FIG. 8, the vibration-exciting weight 50 has a cam shape of a disc having a cutout 50*a* formed by cutting out a part of the disc, which thus is asymmetrical with respect to the output shaft 43*a*. When the output shaft 43*a* rotates at a speed not lower than a prescribed speed, a centrifugal force exerted on the cutout portion 50*a* is smaller than at other portions, so that a non-uniform centrifugal force is applied to the vibration-exciting weight 50. This centrifugal force is transmitted to the output shaft 43*a* and causes the vibration motor 43 to vibrate. The vibration-exciting weight 50 is not limited in shape to a cam shape and can have an arbitrary shape such that the center of gravity of the vibration-exciting weight 50 is shifted with respect to the output shaft 43*a*.

Figure 9:
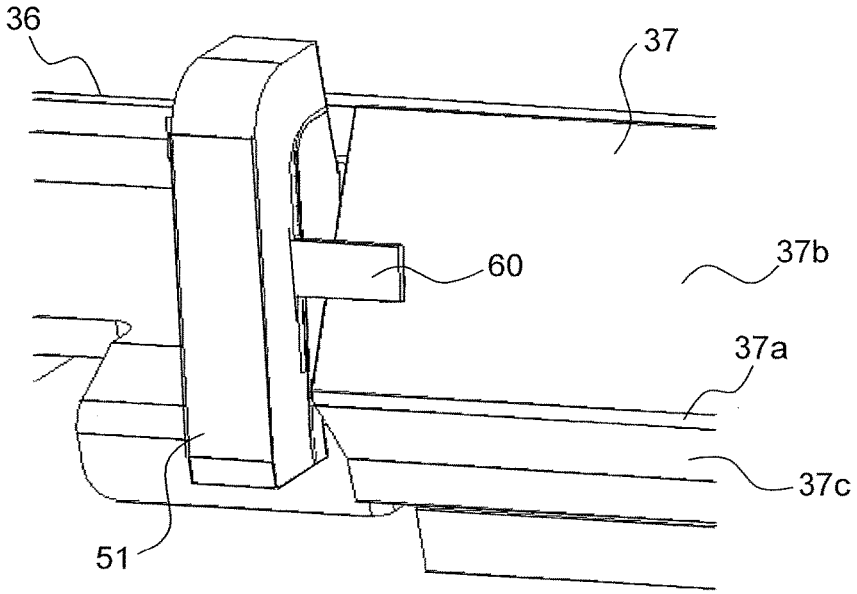
FIG. 9 is an enlarged perspective view showing a configuration of one end portion (left end portion in FIG. 3) of the toner receiving support member 35 used in the developing device 3*a* of this embodiment.
Figure 10:
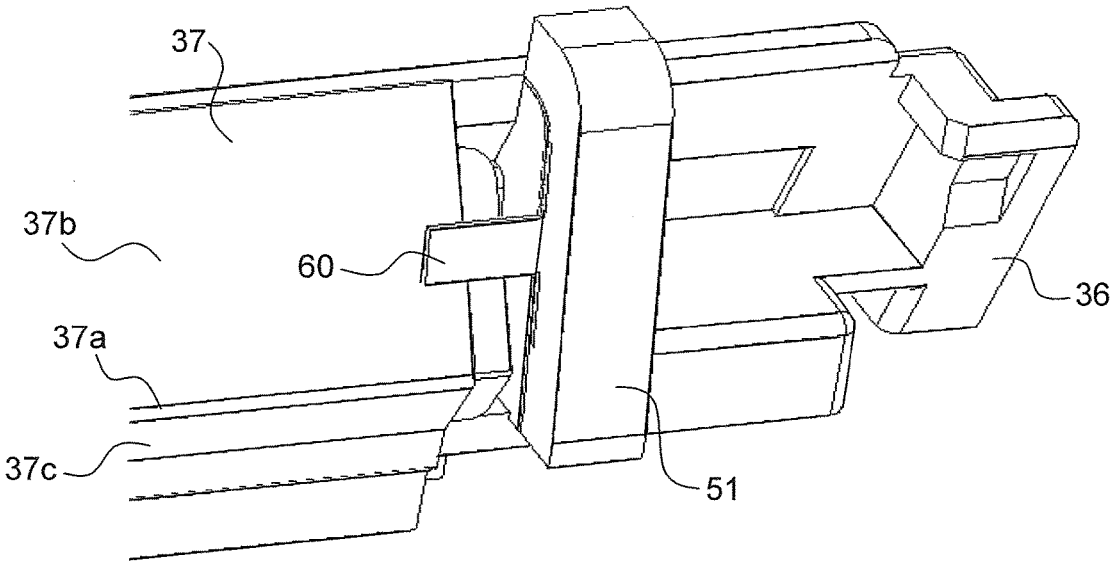
FIG. 10 is an enlarged perspective view showing a configuration of the other end portion (right end portion in FIG. 3) of the toner receiving support member 35 used in the developing device 3*a* of this embodiment.

FIG. 9 and FIG. 10 are enlarged perspective views showing configurations of one end portion (left end portion in FIG. 3) and the other end portion (right end portion in FIG. 3) of the toner receiving support member 35 used in the developing device 3*a*, respectively. At each of the both end portions of the support member main body 36, an end portion seal 51 that is formed of an elastic member such as sponge is fastened. When the toner receiving support member 35 is mounted to the development container 20, the end portion seal 51 comes in contact with an inside surface of the development container 20 and thus prevents toner leakage through a clearance between the development container 20 and the toner receiving support member 35.

Furthermore, at each of the both end portions of the support member main body 36, the vibration inhibition member 60 is fastened so as to be sandwiched between the support member main body 36 and the end portion seal 51. In a state where the toner receiving member 37 is not vibrating, the vibration inhibition member 60 is in contact with the toner receiving surface 37*b* of the toner receiving member 37.

Figure 11:
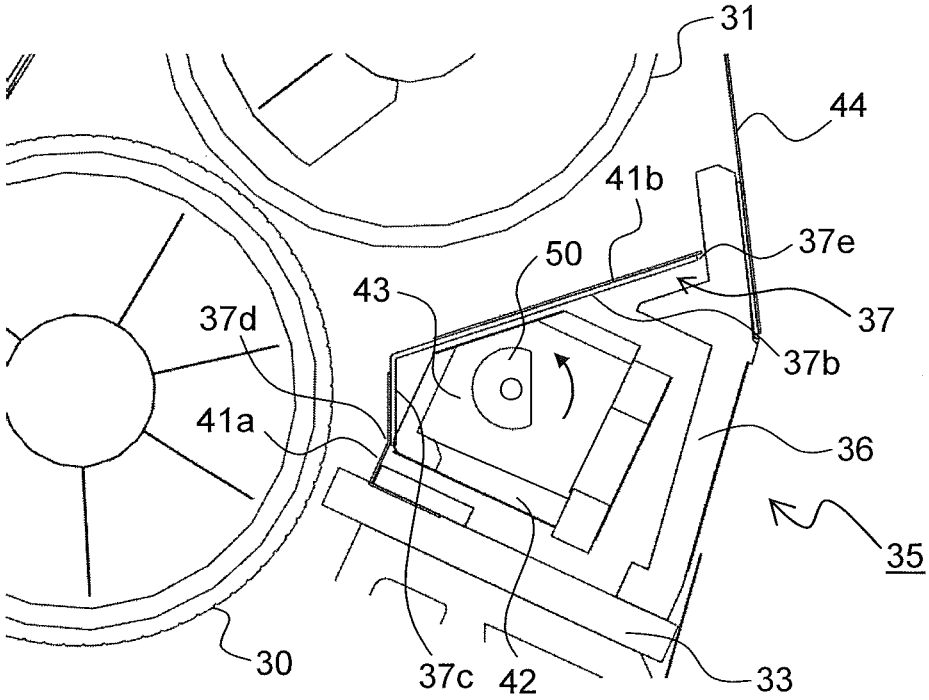
FIG. 11 is a side sectional view, at a vicinity of the vibration motor 43, of the toner receiving support member 35 used in the developing device 3*a* of this embodiment.
Figure 12:
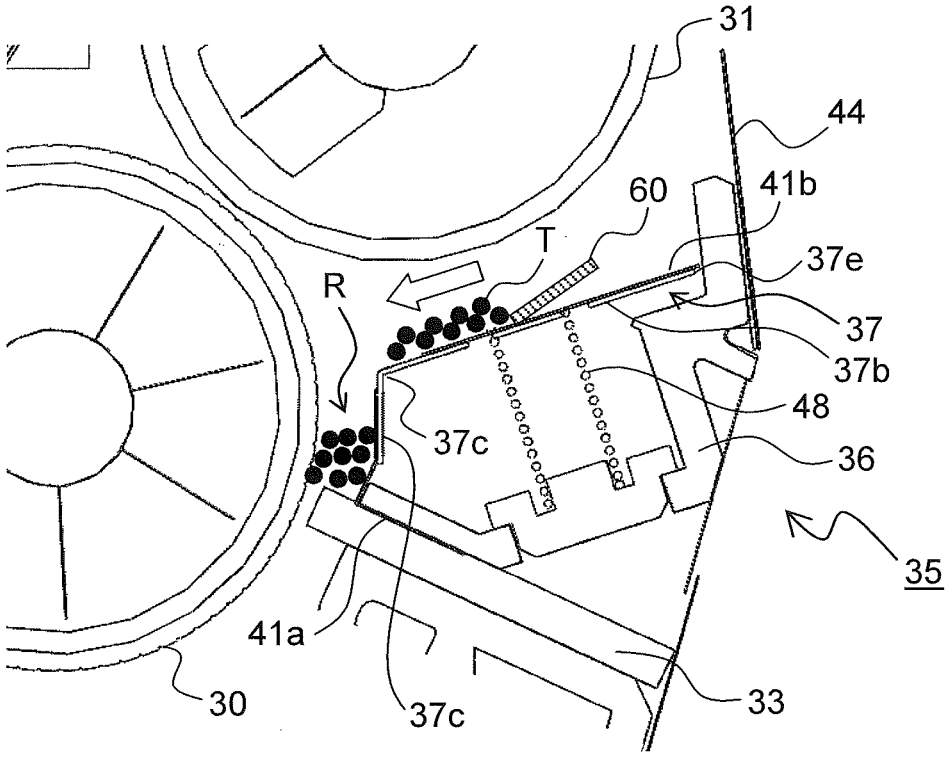
FIG. 12 is a side sectional view, at a vicinity of a contact point spring 48, of the toner receiving support member 35 used in the developing device 3*a* of this embodiment.

FIG. 11 and FIG. 12 are side sectional views showing an internal structure of the toner receiving support member 35 used in the developing device 3*a*. FIG. 11 shows a cross section of the toner receiving support member 35 at a vicinity of the vibration motor 43 (cross section taken along arrows XX' in FIG. 3), and FIG. 12 shows a cross section of the toner receiving support member 35 including the contact point spring 48 (cross section taken along arrows YY' in FIG. 3).

As shown in FIG. 11 and FIG. 12, the toner receiving member 37 is in abutment with the support member main body 36 only at an end edge 37*d* thereof on a toner supply roller 30 side, and an end edge 37*e* thereof on the opposite side (photosensitive drum 1*a* side) is a free end. Further, a substantially center portion of the toner receiving surface 37*b* in a width direction thereof (lateral direction in FIG. 11) is supported by the support member main body 36 via the vibration generation device 40. Thus, the toner receiving member 37 is configured to be swingable about the end edge 37*d* as a fulcrum. Furthermore, the vibration motor 43 is disposed in such a manner that the output shaft 43*a* is substantially parallel to the longitudinal direction of the toner receiving member 37.

The toner receiving member 37 is disposed in such a manner that the toner receiving surface 37*b* thereof opposed to the developing roller 31 is inclined upward from the toner supply roller 30 side toward the photosensitive drum 1*a* side and that the toner dropping surface 37*c* thereof opposed to the toner supply roller 30 is substantially perpendicular.

The sheet member 41*a* is glued so as to cover that surface of the toner receiving member 37 (toner dropping surface 37*c*) which includes a boundary between the support member main body 36 and the toner receiving member 37 on an ear cutting blade 33 side. Furthermore, the sheet member 41*b* is glued so as to cover an entire region of the toner receiving surface 37*b* including a boundary between the support member main body 36 and the toner receiving member 37 on a seal member 44 side, the engagement portion 38, and the holding portion 39 (see FIG. 5). The sheet members 41*a* and 41*b* suppress toner adhesion to the toner receiving surface 37*b* and the toner dropping surface 37*c*, and prevents toner leakage through a boundary between the toner receiving support member 35 and the toner receiving member 37, toner entry into an interior of the toner receiving support member 35, and a malfunction of the vibration motor 43 attributable to toner entry thereinto.

Moreover, above each of both end portions of the toner receiving member 37 in the longitudinal direction thereof, the sheet-shaped vibration inhibition member 60 is disposed. The vibration inhibition member 60 is in contact, at an end portion thereof on the toner supply roller 30 side (left side in FIG. 12), with the toner receiving member 37 and is disposed at a prescribed angle with respect to the toner receiving surface 37*b* so as to be gradually separated from the toner receiving member 37 toward an end portion 60*b* thereof on the photosensitive drum 1*a* side (right side in FIG. 12).

In a non-image forming time, the output shaft 43*a* is caused to rotate at a high speed (for example, on the order of 10,000 rpm), and thus the vibration-exciting weight 50 also is caused to rotate at a high speed together with the output shaft 43*a*. At this time, a non-uniform centrifugal force is applied to the vibration-exciting weight 50, and this causes, via the output shaft 43*a*, the vibration generation device 40 including the vibration motor 43 and the motor mounting holder 42 to vibrate. Further, the toner receiving member 37 to which the vibration generation device 40 is mounted also vibrates. Specifically, with respect to the end edge 37*d* as a fulcrum, the toner receiving surface 37*b* of the toner receiving member 37 vibrates so as to increase in amplitude toward the end edge 37*e*.

As shown in FIG. 12, the vibration of the toner receiving surface 37*b* causes toner T deposited on the toner receiving surface 37*b* to slide down (in a hollow arrow direction in FIG. 12) along an inclination of the toner receiving surface 37*b* to drop freely to a region R that is sandwiched between the substantially perpendicular toner dropping surface 37*c* and the toner supply roller 30. A part of the toner that has dropped to the region R directly passes through the clearance between the ear cutting blade 33 and the toner supply roller 30 to drop into the supply conveyance chamber 22.

Here, in order for toner that has dropped in the region R to be returned to the supply conveyance chamber 22, in the non-image forming time, the developing roller 31 and the toner supply roller 30 are caused to rotate (rotate forward) in the same direction as in an image forming time (counter-clockwise direction in FIG. 11). With the toner supply roller 30 caused to rotate forward, a part of the toner that has dropped in the region R is collected by a magnetic brush on the toner supply roller 30. The part of the toner thus collected, together with the magnetic brush, rotates following rotation of the toner supply roller 30 and, after being peeled off from the toner supply roller 30 at the same polarity portion of the stationary magnet body, drops into the supply conveyance chamber 22.

With the developing roller 31 and the toner supply roller 30 caused to rotate forward, a part of the toner that has adhered to the magnetic brush on the toner supply roller 30 moves onto the developing roller 31. In the non-image forming time, however, no development bias has been applied to the developing roller 31, and thus even when, by rotation of the developing roller 31, the toner in a state of adhering to a surface of the developing roller 31 passes through the opposing portion where the developing roller 31 is opposed to the photosensitive drum 1*a*, there is no possibility that the toner moves to the photosensitive drum 1*a* side.

By the way, in order for toner that has dropped in the region R to be returned to the supply conveyance chamber 22, a method is also possible in which, in the non-image forming time, the developing roller 31 and the toner supply roller 30 are caused to rotate (rotate reversely) in a reverse direction to that in the image forming time (clockwise direction in FIG. 11). With the toner supply roller 30 caused to rotate reversely, the toner that has dropped in the region R to be deposited at a tip end of the ear cutting blade 33 is scraped off by a magnetic brush on the toner supply roller 30 and rotates following rotation of a surface of the toner supply roller 30 to pass through the clearance between the toner supply roller 30 and the ear cutting blade 33. After being peeled off from the toner supply roller 30 at the same polarity portion of the stationary magnet body, the toner is forcibly returned to the supply conveyance chamber 22.

In a case where the developing roller 31 and the toner supply roller 30 are caused to rotate reversely, a magnetic force and a disposition of one of the magnetic poles (regulation pole) of the stationary magnet body, which is opposed to the ear cutting blade 33, are adjusted so that an ear of a magnetic brush formed on the toner supply roller 30 increases in length, and thus an effect of scraping off toner deposited at the tip end of the ear cutting blade 33 is enhanced. Furthermore, when the developing roller 31 and the toner supply roller 30 are caused to rotate reversely, the stir conveyance screw 25*a* and the supply conveyance screw 25*b* also rotate reversely, leading to a possibility that a developer in the development container 20 overflows through the toner replenishment port or that in the development chamber 20, uneven distribution of the developer occurs to cause noise of the toner concentration sensor. For this reason, after the developing roller 31 and the toner supply roller 30 are caused to rotate reversely, preferably, the developing roller 31 and the toner supply roller 30 are caused to rotate forward for a given length of time.

In this embodiment, the output shaft 43*a* of the vibration motor 43 is caused to rotate in such a direction that an outer peripheral surface of the output shaft 43*a* on a side opposed to the toner receiving member 37 moves from the free end (end edge 37*e*) of the toner receiving member 37 toward the fulcrum (end edge 37*d*) thereof (counterclockwise direction in FIG. 11). With the output shaft 43*a* caused to rotate in this direction, the toner receiving member 37 vibrates so as to cause toner deposited on the toner receiving surface 37*b* to move from an end edge 37*e* side to an end edge 37*d* side.

On the other hand, in a case where the output shaft 43*a* is caused to rotate in the reverse direction (clockwise direction in FIG. 11), by vibration of the toner receiving member 37, toner is disadvantageously caused to move so as to be lifted up from the end edge 37*d* side to the end edge 37*e* side, because of which toner deposited on the toner receiving surface 37*b* fails to slide down. Thus, with the output shaft 43*a* of the vibration motor 43 caused to rotate as in this embodiment, toner deposited on the toner receiving surface 37*b* can be effectively caused to drop in the region R along a downward inclination.

The toner receiving member 37 may be caused to vibrate every time a printing operation is completed or at predetermined timing such as a point in time when the number of printed sheets obtained has reached a prescribed number or a point in time when a temperature in the developing device 3*a* has become not lower than a prescribed temperature. Furthermore, timing for causing the toner receiving member 37 to vibrate and timing for causing the developing roller 31 and the toner supply roller 30 to rotate forward (or rotate reversely) may be the same or different from each other. Furthermore, with the toner receiving member 37 caused to vibrate every time a prescribed number of printed sheets obtained is reached, vibration of the toner receiving member 37 is executed automatically depending on the number of printed sheets obtained. This eliminates the need for a user himself/herself to set manually vibration of the toner receiving member 37, and thus it is possible to avoid setting errors, forgetting to perform setting, or executing unnecessary vibration.

Figure 13:
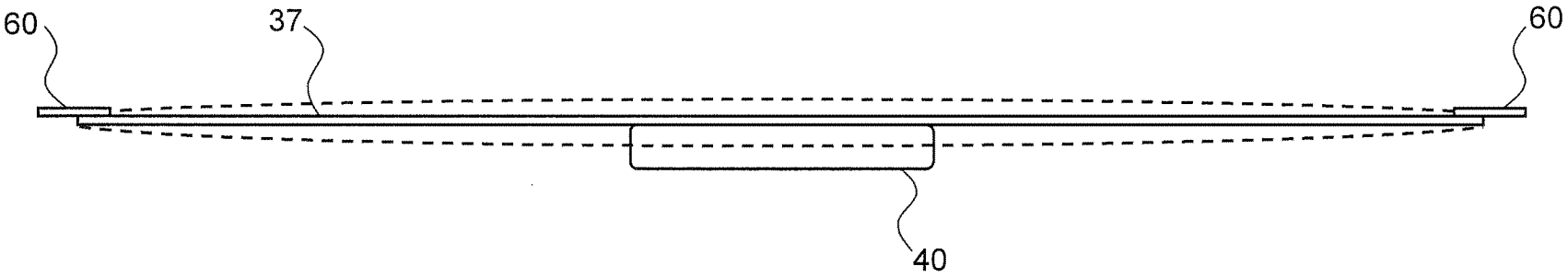
FIG. 13 is a side view of a state in which a toner receiving surface 37*b* of the toner receiving member 37 vibrates as seen from a direction orthogonal to a longitudinal direction of the toner receiving member 37.

FIG. 13 is a side view showing an action of the vibration inhibition member 60 with respect to vibration of the toner receiving member 37. For the sake of convenience for explanation, in FIG. 13, depictions of the portions other than the toner receiving member 37, the vibration generation device 40, and the vibration inhibition member 60 are omitted. In the toner receiving member 37, vibration thereof is suppressed at each of its both end portions in the longitudinal direction thereof, which is in contact with the vibration inhibition member 60. As a result, through the use of a counteraction received from the vibration inhibition member 60, the toner receiving member 37 vibrates to a relatively large degree at its center portion in the longitudinal direction thereof compared with that at its both end portions.

That is, since the toner receiving member 37 is in contact at each of its both end portions in the longitudinal direction thereof with the vibration inhibition member 60, as shown by a broken line in FIG. 13, the toner receiving surface 37*b* vibrates while being bent in an arc in a longitudinal direction thereof just like a string of a stringed musical instrument. By this vibration of the toner receiving member 37, toner deposited at a center portion of the toner receiving surface 37*b* in a longitudinal direction thereof is splashed up and thus efficiently moves to the end edge 37*d* side.

Meanwhile, at each of the both end portions of the toner receiving member 37 in the longitudinal direction thereof, an amplitude decreases due to the contact with the vibration inhibition member 60 but is large compared with that at the center portion thereof since the both end portions in the longitudinal direction thereof is far from the vibration generation device 40. For this reason, at each of the both end portions of the toner receiving member 37 in the longitudinal direction thereof, even in a state of being in contact with the vibration inhibition member 60, there can be secured a degree of vibration sufficient to cause deposited toner to move to the end edge 37*d* side to drop therefrom.

Thus, even in a case where a compact motor that is small in vibration generation amount is used as the vibration motor 43, there can be secured a degree of vibration sufficient to cause deposited toner to drop across an entire region of the toner receiving member 37 in the longitudinal direction thereof, and thus it is possible, while achieving size reduction of the developing devices 3*a* to 3*d* and the image forming apparatus 100, to suppress effectively occurrence of an image failure resulting from toner dropping.

Figure 14:
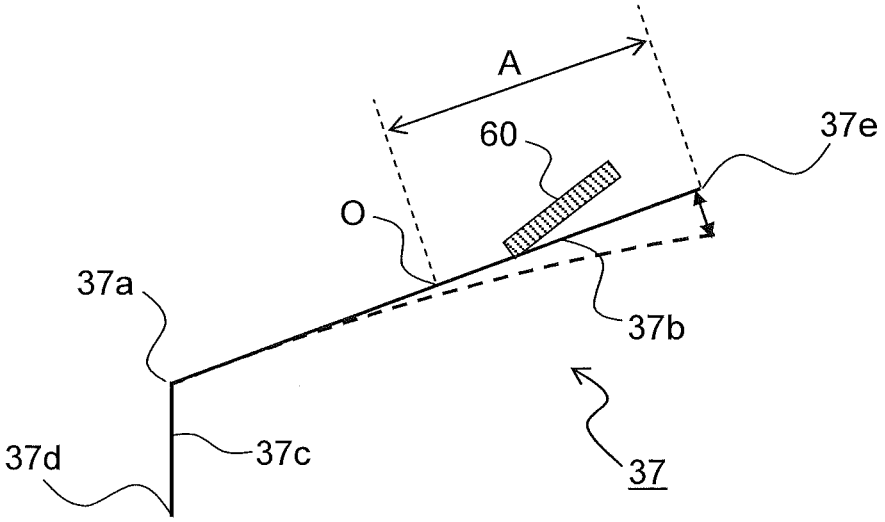
FIG. 14 is a side view of a contact position of a vibration inhibition member 60 with respect to the toner receiving surface 37*b* of the toner receiving member 37 as seen from the longitudinal direction of the toner receiving member 37.

Here, since the toner receiving member 37 vibrates with respect to the end edge 37*d* thereof on the toner supply roller 30 side as a fulcrum, an amplitude increases with increasing proximity to the end edge 37*e* thereof on the photosensitive drum 1*a* side, which is the free end. Because of this, in a case where the vibration inhibition member 60 is disposed so as to be in contact with the toner receiving surface 37*b* at a vicinity of the end edge 37*d* thereof, vibration of the toner receiving member 37 cannot be suppressed sufficiently, resulting in decreasing an effect of increasing an amplitude of the toner receiving member 37 at its center portion in the longitudinal direction thereof through the use of a counteraction received from the vibration inhibition member 60. For this reason, preferably, as shown in FIG. 14, the vibration inhibition member 60 is disposed so as to be in contact with the toner receiving surface 37*b* in a range (shown by an arrow A) extending from a center portion O of the toner receiving surface 37*b* in the width direction thereof to the end edge 37*e* on the photosensitive drum 1*a* side.

Other than the above, the present disclosure is not limited to the above-described embodiment, and various modifications are possible without departing from the spirit of the present disclosure. For example, the respective shapes and configurations of the toner receiving support member 35, the toner receiving member 37, and the vibration inhibition member 60 described in the above-described embodiment are shown merely as one example and, without being particularly limited to the above-described embodiment, can be set as appropriate depending on an apparatus configuration or the like.

Figure 15:
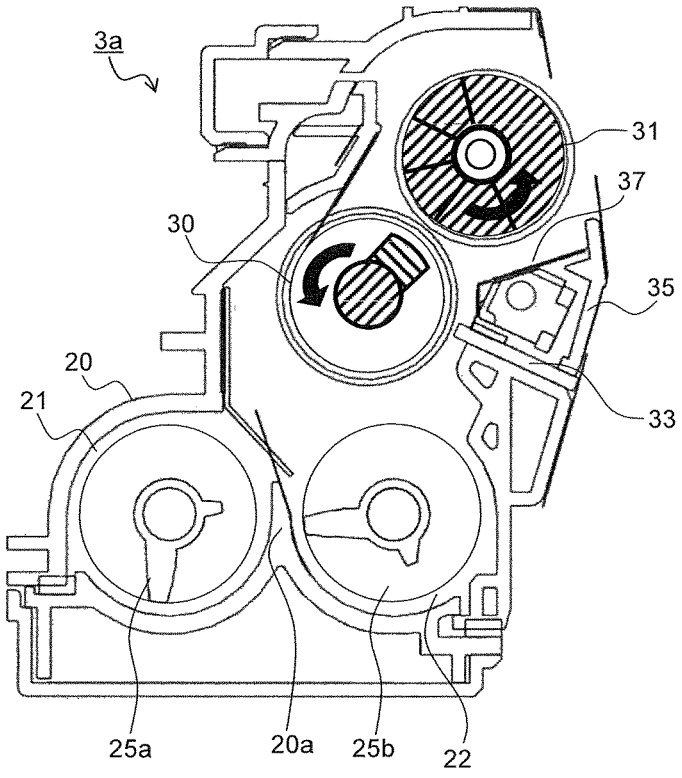
FIG. 15 is a side sectional view showing a developing device 3*a* of the present disclosure in which a toner supply roller 30 and a developing roller 31 are disposed in reversed positions relative to each other.

Furthermore, while in the above-described embodiment, the present disclosure is applied to the developing devices 3*a* to 3*d* that employ a two-component developer to form a magnetic brush on the toner supply roller 30, cause only toner to move from the toner supply roller 30 to the developing roller 31, and supply the toner from the developing roller 31 to the photosensitive drums 1*a* to 1*d*, respectively, besides that, the present disclosure can be applied also to a developing device in which, as shown in FIG. 15, the developing roller 31 and the toner supply roller 30 are disposed in reversed positions to those in the above-described embodiment, a magnetic brush made of a two-component developer that is held on the surface of the developing roller 31 (in this configuration, a magnetic roller having a similar configuration to that of the toner supply roller 30 in the above-described embodiment) is used to supply toner to the photosensitive drums 1*a* to 1*d*, toner held on the surface of the toner supply roller 30 (in this configuration, having a similar configuration to that of the developing roller 31 in the above-described embodiment) is supplied to the developing roller 31, and by using the toner supply roller 30, excess toner on the surface of the developing roller 31 is collected. Also in this configuration, it is possible to suppress effectively deposition of toner, which has dropped from the developing roller 31, at a periphery of the ear cutting blade 33 opposed to the toner supply roller 30. The following further specifically describes an effect of the present disclosure by way of an example.

Examples

A study was made on how vibration of the toner receiving member 37 in the longitudinal direction thereof varied depending on whether or not the vibration inhibition member 60 was provided. As a testing method, by using the developing device 3*a* of this embodiment provided with the vibration inhibition member 60 being in contact with each of the both end portions of the toner receiving member 37 in the longitudinal direction thereof (the present disclosure) and a developing device 3*a* having a similar configuration to that of the present disclosure except for not being provided with the vibration inhibition member 60 (Comparative Example), a vibration waveform (amplitude) was measured with respect to varying positions on the toner receiving member 37 in the longitudinal direction thereof.

Figure 16:
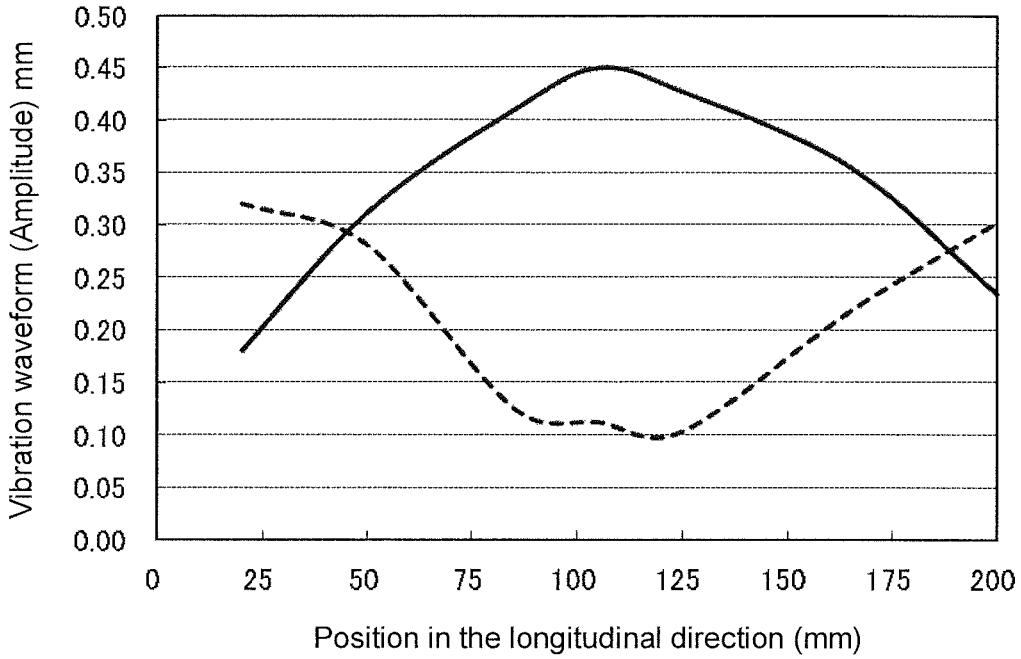
FIG. 16 is a graph for comparing, in Example, variations in amplitude in the longitudinal direction of the toner receiving member 37 between a case where the vibration inhibition member 60 is provided (present disclosure) and a case where the vibration inhibition member 60 is not provided (Comparative Example).

The toner receiving member 37 used was made of stainless steel and was 220 mm in length, 6.5 mm in width (the toner receiving surface 37*b*), and 0.2 mm in thickness. As the vibration motor 43, there was used a motor having a rated rpm of 9,500±3,000, a rated voltage of 3.0 V (rated voltage range of 2.6 to 3.6 V), a rated current of 75 mA, and a starting current of 85 mA, and a semicircular column-shaped tungsten alloy weight (27.8 $mm^3$ in volume, 0.5 g in mass) that was 3.5 mm in length and had a semicircular bottom surface having a radius of 2.25 mm and a central angle of 180° was fastened to the output shaft 43*a*. FIG. 16 shows a result of the study.

As shown in FIG. 16, in the developing device 3*a* of the present disclosure provided with the vibration inhibition member 60 being in contact with each of both end portions of the toner receiving surface 37*b* in the longitudinal direction thereof (shown by a solid line in FIG. 16), an amplitude of the toner receiving member 37 was 0.18 mm at one end portion (position at 20 mm) in the longitudinal direction thereof, 0.45 mm at the center portion (position at 100 to 120 mm) in the longitudinal direction thereof, and 0.24 mm at the other end portion (position at 200 mm) in the longitudinal direction thereof, with all of these values exceeding a limit amplitude of 0.1 mm at or above which toner dropping occurs.

In contrast, in the developing device 3*a* of Comparative Example without the vibration inhibition member 60 (shown by a broken line in FIG. 16), an amplitude of the toner receiving member 37 was 0.32 mm at one end portion (position at 20 mm) in the longitudinal direction thereof and 0.30 mm at the other end portion (position at 200 mm) in the longitudinal direction thereof, while an amplitude thereof at the center portion (position at 100 to 120 mm) in the longitudinal direction thereof was lower than 0.1 mm. This result confirms that in the developing device 3*a* of the present disclosure, a toner dropping effect is obtained across the entire region of the toner receiving member 37 in the longitudinal direction thereof.

The present disclosure is applicable to a developing device having a toner receiving member that is opposed to a developing roller in an area between an opposing region where an image carrier and the developing roller are opposed to each other and a regulation blade. Through the use of the present disclosure, it is possible to provide a developing device that can suppress effectively, by using a compact motor, deposition of toner on a toner receiving member, and an image forming apparatus including the same.

What is claimed is:

1. A developing device, comprising:

a developing roller that is disposed so as to be opposed to an image carrier on which an electrostatic latent image is formed and supplies toner to the image carrier in an opposing region where the developing roller is opposed to the image carrier;

a toner supply roller that is disposed so as to be opposed to the developing roller and supplies toner to the developing roller in an opposing region where the toner supply roller is opposed to the developing roller;

a regulation blade that is disposed so as to be opposed to the toner supply roller at a prescribed spacing therefrom;

a casing that houses the developing roller, the toner supply roller, and the regulation blade;

a toner receiving support member that is disposed in the casing so as to be opposed to the developing roller or the toner supply roller in an area between the regulation blade and the image carrier;

a toner receiving member that is disposed along a longitudinal direction of the toner receiving support member, has a toner receiving surface that receives toner dropping from the developing roller, and is supported so as to be swingable about an end edge of the toner receiving member on toner supply roller side in a width direction of the toner receiving member perpendicular to the longitudinal direction as a fulcrum, with another end edge of the toner receiving member on an image carrier side in the width direction of the toner receiving member being a free end;

a vibration generation device that causes the toner receiving member to vibrate; and a vibration inhibition member that is provided at the toner receiving support member and, in a state where the toner receiving member is not vibrating, only a front end side, that is facing the toner supply roller, of the vibration inhibition member, is in direct contact with each of both end portions of the toner receiving surface in a longitudinal direction of the toner receiving surface.

2. The developing device according to claim 1, wherein the vibration inhibition member is in contact with the toner receiving surface in an area between a center portion of the toner receiving surface in a width direction thereof and the end portion of the toner receiving surface on the image carrier side.

3. The developing device according to claim 1, wherein the vibration inhibition member is in contact, at an end portion thereof on the toner supply roller side in the width direction of the toner receiving member, with the toner receiving surface and is disposed at an angle with respect to the toner receiving surface so as to be gradually separated from the toner receiving member toward the end edge thereof on the image carrier side in the width direction of the toner receiving member.

4. The developing device according to claim 1, wherein in a non-image forming time, the toner receiving member is caused to vibrate by the vibration generation device, and the developing roller and the toner supply roller are caused to rotate in a same direction as in an image forming time.

5. The developing device according to claim 1, wherein the vibration generation device comprises:

a vibration motor that is fastened to a back of the toner receiving member; and a vibration-exciting weight, wherein when the vibration-exciting weight is fastened to an output shaft of the vibration motor, a center of gravity of the vibration-exciting weight is shifted with respect to the output shaft.

6. The developing device according to claim 5, wherein when the vibration motor is fastened to the back of the toner receiving member, the output shaft is parallel to the longitudinal direction of the toner receiving support member, and when the output shaft of the vibration motor is caused to rotate, an outer peripheral surface of the output shaft on a side opposed to the toner receiving member moves from free end side of the toner receiving member toward the fulcrum side thereof.

7. The developing device according to claim 1, wherein the toner receiving member is bent in a convex shape in cross section at a bent portion that is parallel in the longitudinal direction of the toner receiving support member and is divided into the toner receiving surface above the bent portion and a toner dropping surface below the bent portion, and the toner receiving member is disposed in such a manner that the toner receiving surface is inclined upward from the toner supply roller side toward the image carrier side and that the toner dropping surface below the bent portion is perpendicular.

8. The developing device according to claim 1, wherein a sheet member that is lower in toner adhesion than the toner receiving member is glued to a top surface of the toner receiving member, which is opposed to the developing roller or the toner supply roller side.

9. The developing device according to claim 1, wherein the toner supply roller is a magnetic roller that carries, by using an effect of a plurality of magnetic poles provided therein, a two-component developer containing toner and a carrier.

10. The developing device according to claim 1, wherein the developing roller is a magnetic roller that carries, by using an effect of a plurality of magnetic poles provided therein, a two-component developer containing toner and a carrier.

11. An image forming apparatus comprising the developing device according to claim 1.

* * * * *